US006182488B1

(12) United States Patent
Bieling

(10) Patent No.: US 6,182,488 B1
(45) Date of Patent: Feb. 6, 2001

(54) TENSIONING DEVICE FOR AN INTERNAL HIGH-PRESSURE FORMING TOOL

(75) Inventor: Peter Bieling, Nalbach (DE)

(73) Assignee: Anton Bauer Werkzeug-und Maschinenbau GmbH & Co. KG, Dillingen (DE)

( * ) Notice: Under 35 U.S.C. 154(b), the term of this patent shall be extended for 0 days.

(21) Appl. No.: 09/154,909

(22) Filed: Sep. 17, 1998

(51) Int. Cl.[7] ..... B21D 26/02; B21D 22/10
(52) U.S. Cl. ..... 72/60; 72/455; 100/214
(58) Field of Search ..... 72/60, 61, 455; 100/214

(56) References Cited

U.S. PATENT DOCUMENTS

| | | | | |
|---|---|---|---|---|
| 4,068,514 | | 1/1978 | Chachin et al. . | |
| 4,111,024 | * | 9/1978 | Dahlman | 72/60 |
| 4,306,436 | * | 12/1981 | Schulz et al. | 72/60 |
| 4,474,044 | * | 10/1984 | Leistner et al. | 72/60 |
| 5,415,021 | * | 5/1995 | Folmer | 72/60 |
| 5,570,602 | | 11/1996 | Bauer . | |
| 5,628,220 | * | 5/1997 | Schafer | 72/61 |
| 5,728,309 | * | 3/1998 | Matsen et al. | 72/60 |

FOREIGN PATENT DOCUMENTS

| | | |
|---|---|---|
| 0686440 | 12/1995 | (EP) . |
| 2224965 | 5/1990 | (GB) . |

* cited by examiner

*Primary Examiner*—David Jones
(74) *Attorney, Agent, or Firm*—Friedrich Kueffner

(57) ABSTRACT

A clamping device for internal high-pressure forming includes a tool carrier (1), a tension clamping holder (3, 4) which extends from the tool carrier (1), a clamping jaw (8) which is arranged opposite from the tool carrier, and a bayonet clamping device (13–16) for holding together the forming tool parts between the clamping jaw and the tool carrier, which bayonet clamping device (13–16) wedges the clamping jaw between the tension clamping holder and the forming tool. The tension clamping holder has at least one feed opening which is suitable for guiding the forming tool into the working position in a direction vertical to the clamping direction. This solution substantially facilitates the installation of forming tools in the device.

20 Claims, 3 Drawing Sheets

TENSIONING DEVICE FOR AN INTERNAL HIGH-PRESSURE FORMING TOOL

BACKGROUND OF THE INVENTION

1. Field of the Invention

The invention is directed to a clamping device for holding together parts of a forming tool in internal high-pressure forming with a tool carrier forming a clamping jaw, a tension clamping holder which extends from the tool carrier so as to be offset relative to the working position of the forming tool, a movable clamping jaw which is arranged opposite from the tool carrier, and a quarter-turn or bayonet clamping device for holding together the forming tool parts between the movable clamping jaw and the tool carrier, which bayonet clamping device wedges the movable clamping jaw between the tension clamping holder and the forming tool.

2. Description of the Related Art

Clamping devices of the kind mentioned above are known for holding together parts of a forming tool in internal high-pressure forming, in which the tool carrier, together with the tension clamping holder, is constructed in a cup-like manner with the cup base as tool holder. Openings are provided in the vertical cylindrical cup wall for introducing pressure fluid supply lines to be applied to a workpiece to be formed and for charging the forming tool with a workpiece to be formed. To install a tool, the clamping jaw is raised in the disengaged state of the bayonet clamping device until the cup-shaped tool holder is accessible from above. The tool and, as the case may be, spacers are then introduced vertically from above into the tool holder.

SUMMARY OF THE INVENTION

It is the object of the present invention to provide a novel clamping device of the type mentioned above which is easier to handle especially with respect to tool installations.

In a clamping device according to the invention which meets this object, the tension clamping holder has at least one feed opening which is suitable for feeding the forming tool into the working position in a direction vertical to the clamping direction.

In comparison to feeding from above as practiced in the prior art, the arrangement, according to the invention, of the tension clamping device such that the tool parts can be fed to the tool carrier horizontally from the side appreciably facilitates tool assembly.

The tension clamping device could have, e.g., two plates extending from the tool carrier at a distance from one another, so that a tool could be arranged proceeding from two sides between the plates on the tool carrier.

The largest possible free installation space results in a preferred embodiment form of the invention in which the tension clamping holder has holder columns extending from a tool carrier which is plate-shaped in particular and a carrier platform which is arranged at the holder columns at a distance from the tool carrier with an opening for the movable clamping jaw and hooking parts of the bayonet clamping device which are arranged around the opening, wherein the largest possible feed openings are formed between the holder columns.

In the clamping position, the clamping jaw then projects downward from the carrier platform, wherein it is wedged via the bayonet clamping device between a tool arranged on the tool carrier and the carrier platform. In an advisable embodiment form of the invention, the distance of the carrier platform from the tool carrier can be varied in order to adjust different clamping starting positions, i.e., the carrier platform can be raised or lowered.

In an advantageous embodiment form, the device has a lifting device for raising and lowering the clamping jaw, wherein this lifting device can serve simultaneously for holding the clamping jaw for as long as the clamping jaw does not rest against a forming tool.

According to a preferred embodiment, this lifting device which can also be formed, e.g., by one or more hydraulic cylinders, is arranged by a piston rod connected with the clamping jaw on an additional carrier platform which is arranged over the carrier platform, wherein the additional carrier platform is advantageously supported against the carrier platform having the opening. This last step ensures that no corresponding change in the lifting range of the lifting device is required when adjusting the initial clamping position by means of a vertical adjustment of the carrier platform having the opening.

Further, the device according to the invention has arrangements for vertical guiding of the clamping jaw moved by the lifting device, wherein these guides are substantially formed by guide rods and guide bushings which project from the carrier platform with the opening and are arranged at a plate which is connected to the upper sides of the clamping jaw and projects over the clamping jaw.

In a further advantageous embodiment of the invention, the bayonet clamping device has a bayonet ring mounted on the clamping jaw, wherein the bayonet ring is mounted in particular on an annular shoulder formed at the clamping jaw. The clamping of the clamping jaw by means of a bayonet ring of this kind which is rotatable relative to the clamping jaw has the substantial advantage over bayonet hook parts arranged directly at the clamping jaw that the clamping jaw itself need not be rotated in order to wedge the clamping jaw, which would be disadvantageous in consideration of the pressing contact against the tool.

To ensure short clamping paths when high clamping force is to be transmitted, the bayonet clamping device preferably has a plurality of bayonet hooks forming a toothed rim around the bayonet ring and forming the opening in the carrier platform.

In accordance with a further advantageous embodiment, the bayonet ring has engagement or application bearings for hydraulic rotational actuation devices, wherein these application bearings project upward and are guided through openings formed in the above-mentioned plate, wherein the plate can be provided with counter-bearings for the hydraulic actuation devices.

In a particularly preferred embodiment of the invention, the clamping jaw has, as a counter-clamping device, a counter-pressure chamber which can be acted upon by fluid pressure, e.g., the working pressure of the device, and which opposes deformations of the mold cavity that could occur, e.g., in that the clamping jaw gives way under the influence of the pressing forces occurring during the forming process and the tool parts accordingly move away from one another. The counter-pressure chamber could also be formed in a short-stroke cylinder acting on a clamping jaw and/or on the tool.

A part of the clamping jaw which rests against the tool is preferably movable relative to the rest of the clamping jaw and has a portion which is constructed in the manner of a pressure piston and which can be acted upon by the fluid pressure in the counter-chamber. Given an appropriate application of pressure, a giving way of the clamping jaw is compensated in that the movable portion correspondingly moves forward relative to the clamping jaw and accordingly holds the tool parts in place. The counter-pressure chamber is advisably provided with a flexible sealing lining which is formed in particular from a plastic membrane, so that no special steps need to be taken to seal the pressure piston portion. Due to the possibility of compensation by means of the counter-pressure chamber, it is possible for the parts critical for the stability of the clamping device to be constructed in a less solid manner because a yielding of the clamping jaw can be tolerated to a determined degree.

A construction of the carrier platform which is particularly advisable in this respect provides that the platform has an annular part having the opening with the hooks, the platform with bushing parts connecting the holder columns, and plate braces connecting the bushing parts with the annular part and is accordingly constructed in a relatively lightweight manner.

In a further advantageous arrangement of the invention, the tool carrier has undercut grooves for the clamping fastening of tool parts. Grooves of this type which are provided at a narrow distance from one another in particular and in which hooking holder clamps are displaceable allow virtually any hooking arrangement of these clamps corresponding to different dimensions of tool parts.

The invention will be explained and described more fully with reference to embodiment examples and the accompanying drawings relating to these embodiment examples.

DESCRIPTION OF THE PREFERRED EMBODIMENTS

Figure 2:
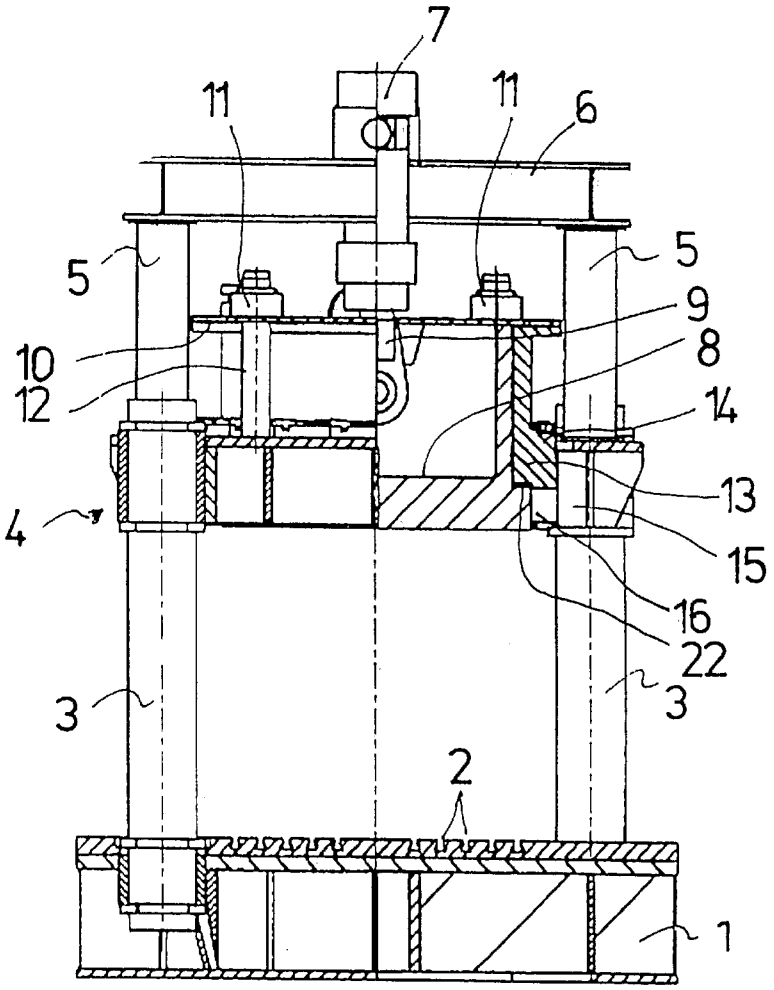
FIG. 2 shows the device of FIG. 1 in a side view (partially in section) vertical to the side view in FIG. 1.

A tool carrier plate which is square in the shown embodiment example is designated by 1 in FIGS. 1 to 4, wherein undercut clamping grooves 2 are provided in the fastening surface of the tool carrier plate. A holder column 3 extends from each of the four corner regions of the tool carrier plate 1. A carrier platform 4 is arranged above the tool carrier 1 at the holder columns 3 at a distance from the tool carrier 1. In the shown embodiment example, the carrier platform 4 is rigidly fastened to the holder columns 3. Instead of this, the carrier platform 4 could also be displaceable at the holder columns 3 and fixed in different height positions over the tool carrier plate 1.

A total of four vertical carriers 5 having an I-section extend from the carrier platform 4 and support another carrier platform 6 which is arranged over carrier platform 4.

A hydraulic cylinder 7 which serves as a lifting device for a clamping jaw 8 arranged at the cylinder rod 9 of the hydraulic cylinder 7 is held in the center of the other carrier platform 6.

A plate 10 which projects over the clamping jaw 8 horizontally on both sides is fastened to the upper side of the clamping jaw 8, a recess being provided in the center of the plate 10 for guiding through the cylinder rod 9 of the hydraulic cylinder 7. A total of four bushings 11 are arranged on the plate 10 so as to be offset horizontally to the clamping jaw 8, wherein guide rods 12 which project upward from the carrier platform 4 are guided in the four bushings 11.

A bayonet ring which is rotatable relative to the clamping jaw 8 and the plate 10 is designated by 13 in FIGS. 1 to 4, wherein the bayonet ring is mounted on the clamping jaw 8 on a shoulder 22 of the clamping jaw 8. The bayonet ring 13 has, as hooking parts of a bayonet clamping device, a plurality of hook teeth 14 which form a toothed rim externally surrounding the clamping ring at its underside. A hooking surface of the teeth which faces upward is slightly beveled. For the purpose of rotational actuation, the bayonet ring is connected with application bearings 17 which project upward through openings in the plate 10. Hydraulic cylinders acting at the application bearings 17 are not shown in FIGS. 1 to 4.

The carrier platform 4 has an annular part 15 with a counter-toothing corresponding to the hooking toothing 14 of the bayonet ring, wherein the teeth 16 of the counter-toothing are provided with a slightly beveled hooking surface which faces downward.

Bushing parts of the carrier platform 4 which are arranged on the holder columns 3 and are connected with the annular part 15 via plate braces 24 are designated by 12.

The manner of operation of the clamping device described in FIGS. 1 to 4 will now be described.

A tool with a lower part facing the tool carrier 1 and an upper part facing the clamping jaw 8 is arranged on the tool carrier plate 1, possibly by means of the fastening grooves 2. The free spaces between the holder columns can be utilized for mounting.

Figure 1:
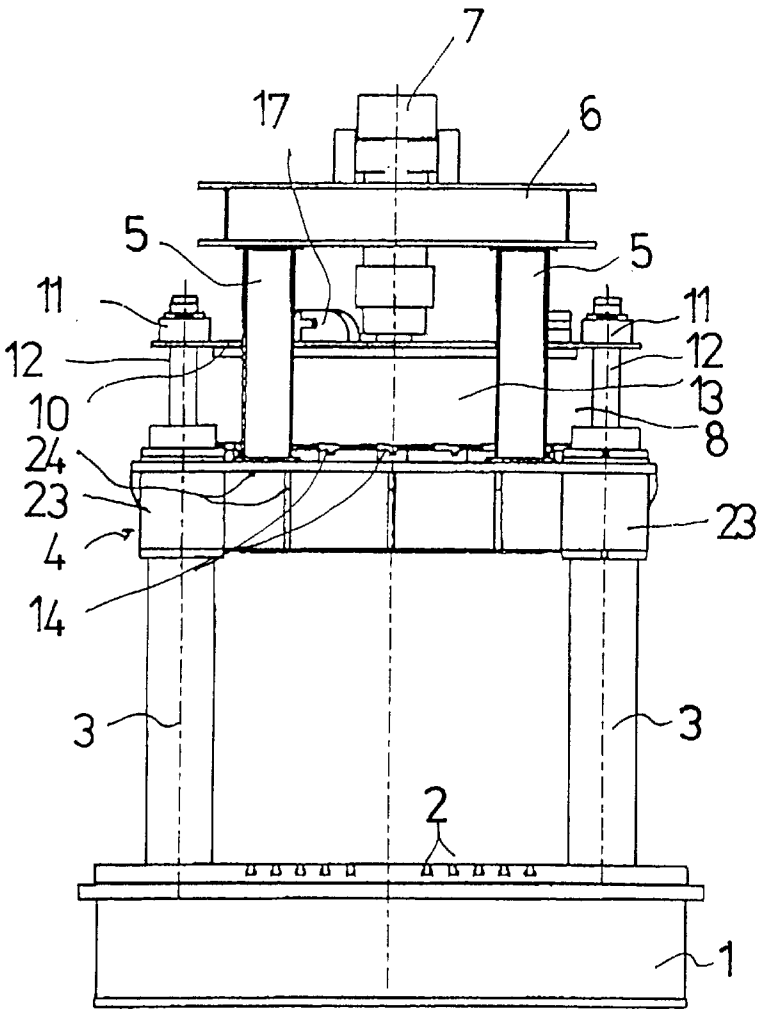
FIG. 1 is a side view showing an embodiment example for a device according to the invention.
Figure 4:
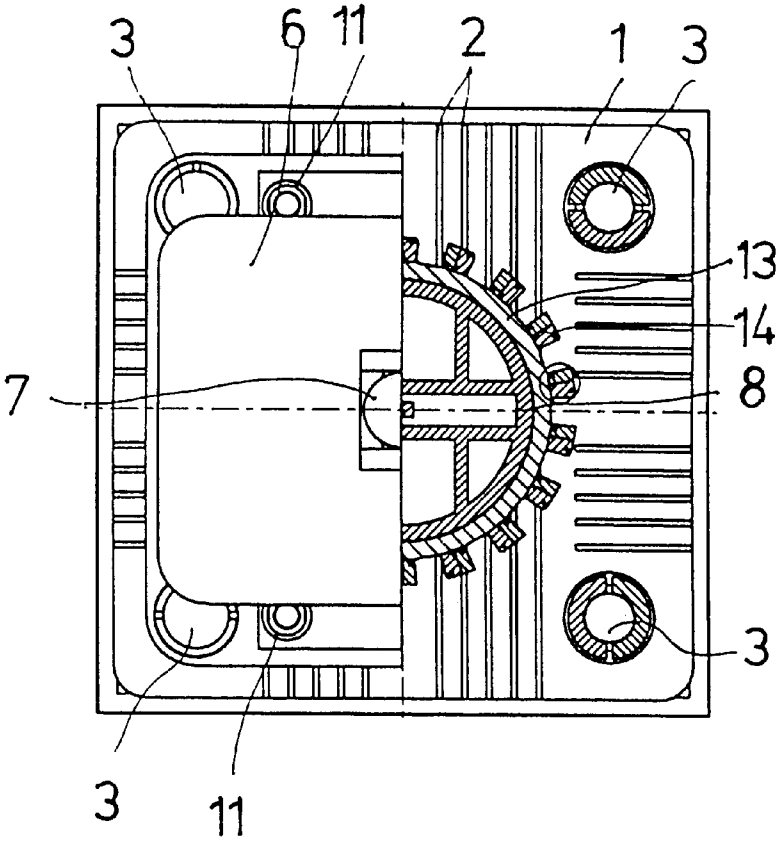
FIG. 4 shows the device according to FIGS. 1 and 2 in a top view with a partial section in a second plane.
Figure 3:
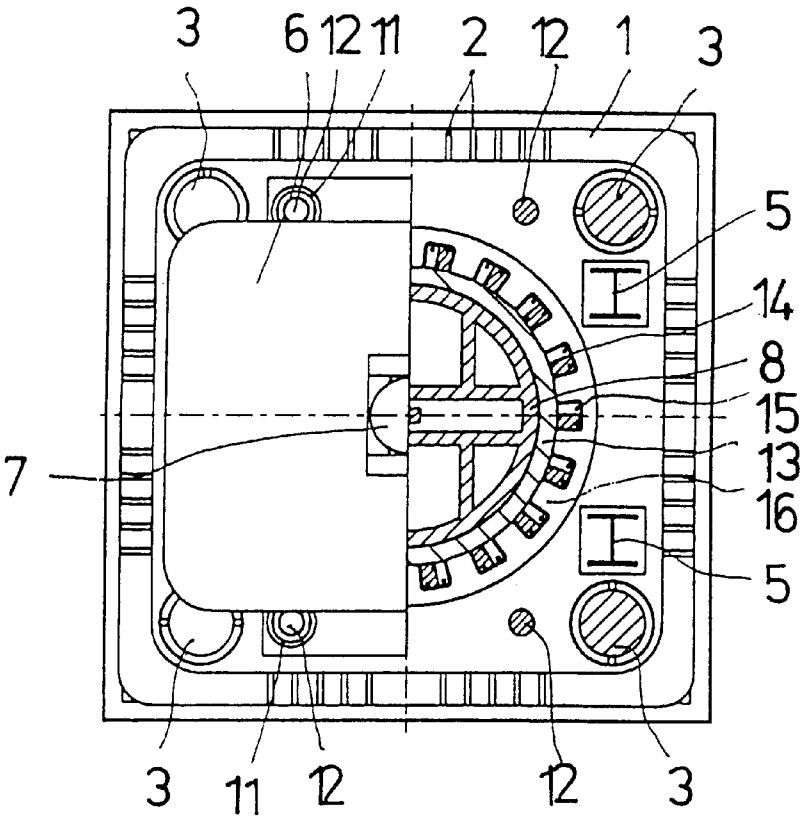
FIG. 3 shows the device according to FIGS. 1 and 2 in a top view with a partial section in a first plane.

The tool installation and the charging of the tool with a workpiece that is to be deformed by internal high-pressure forming is carried out in the raised position of the clamping jaw 8 shown in FIGS. 1 and 2, in which the teeth 14 of the clamping ring 13 are located between the teeth 16 of the annular part 15 of the carrier platform 4 and the clamping jaw 8 terminates at the bottom so as to be approximately flush with the annular part 16. To clamp the tool, the clamping jaw 8 is lowered by the lifting device 7. By means of spacers or, as the case may be, a corresponding height adjustment of the carrier platform 4, it has been ensured beforehand that the upper side of the upper tool part is located at a height such that an initial position suitable for clamping results for the clamping jaw. This suitable initial position is realized when the inclined hooking surfaces rest against one another due to the rotation of the clamping ring 13 and a corresponding clamping force exerted on the tool can thus be generated via the bayonet clamping ring 13.

After the tool parts are pressed tog ether in this way, a fluid pressure can be applied to the workpiece for internal pressure forming by means of pressure application devices, not shown, and the workpiece can be deformed, wherein the clamping device holds together the tool parts.

Figure 5:
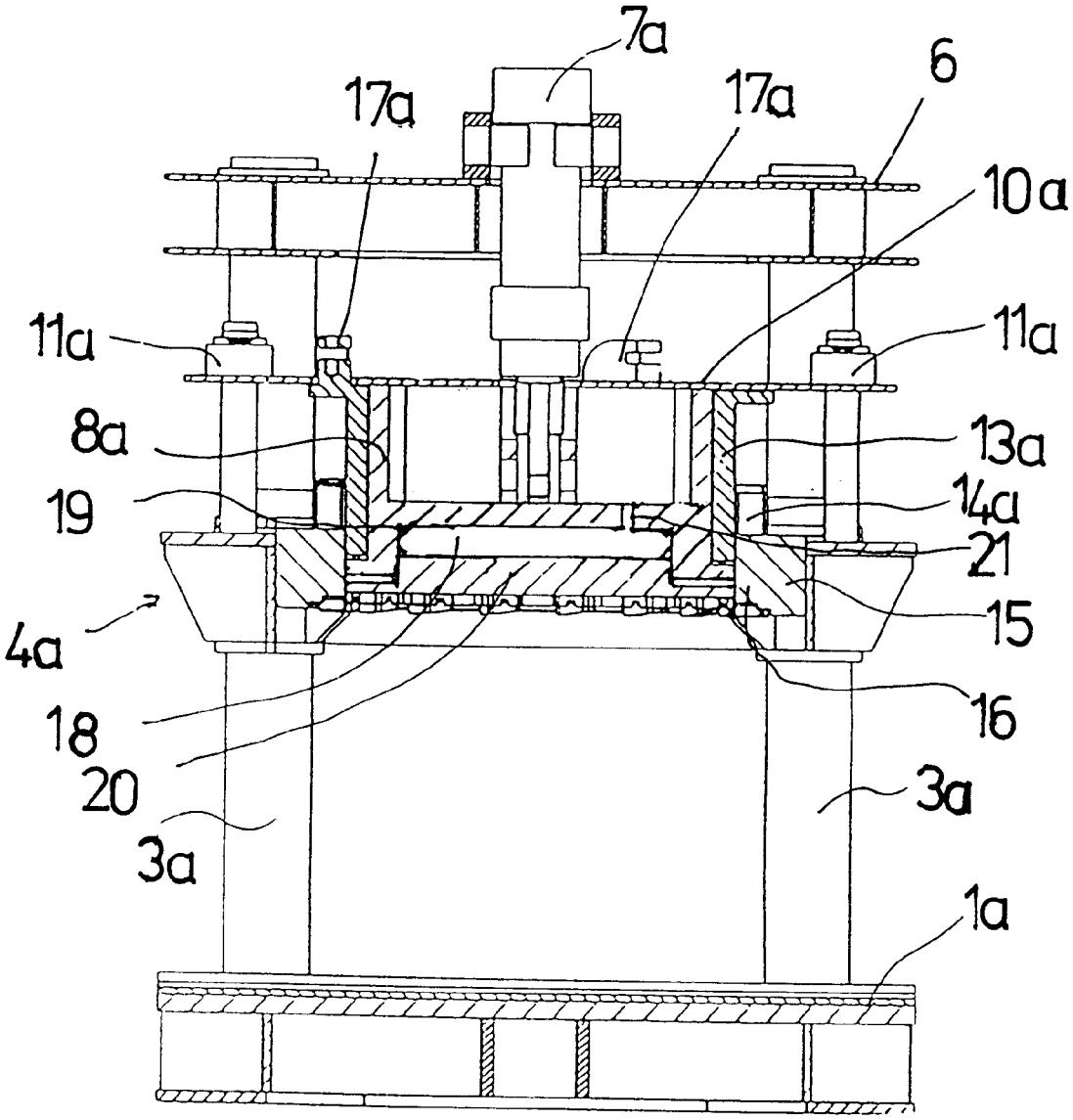
FIG. 5 shows another embodiment example for a device according to the invention.

Reference is had to FIG. 5 in which identical or identically working parts are designated by the same reference numbers supplemented by the letter a.

The embodiment example of FIG. 5 differs from the preceding embodiment example in that an additional platform 6*a* provided for holding a hydraulic cylinder 7*a* is not supported against a platform 4*a* located below it, but rather holder columns 3*a* are lengthened and used for holding the additional carrier platform 6*a*.

Another essential difference consists in that a counter-pressure chamber 18 which can be acted upon via a connection channel 21 by a pressure fluid and in which a sealing, flexible inner lining 19 of plastic material is arranged is provided in a clamping jaw 8*a*. Further, the clamping jaw 8*a* has a lower movable part 20, a portion of which is guided in the clamping jaw 8*a* so as to be movable in the manner of a pressure piston. End stops holding the movable part 20 at the clamping jaw 8*a* are not shown in FIG. 5.

In clamping operation, the counter-pressure chamber 18 is acted upon by fluid pressure, e.g., by the working pressure used for internal high-pressure forming, via the pressure connection channel 21 via connection lines, not shown. By maintaining a suitable pressure in the counter-pressure chamber 18, a giving way of the clamping jaw under the influence of forces transmitted via the tool parts to the clamping jaw is opposed during the internal high-pressure forming.

What is claimed is:

1. A clamping device for holding together parts of a forming tool in internal high-pressure forming, the clamping device comprising a tool carrier forming clamping jaws, a tension clamping holder extending from the tool carrier so as to be offset relative to a working position of the forming tool, a movable clamping jaw mounted opposite the tool carrier and movable in a clamping direction, and a bayonet clamping device for holding together the parts of the forming tool between the movable clamping jaw and the tool carrier, wherein the bayonet clamping device is configured to wedge the movable clamping jaw between the tension clamping holder and the forming tool, and wherein the tension clamping holder has at least one feed opening for guiding the forming tool into the working position in a direction extending perpendicularly of the clamping direction.

2. The clamping device according to claim 1, wherein the tension clamping holder comprises holder columns extending from the tool carrier and a carrier platform mounted at the holder columns at a distance from the tool carrier, the carrier platform having an opening for guiding therethrough the movable clamping jaw and hooking parts of the bayonet clamping device arranged around the opening, wherein the least one feed opening is formed between the holder columns.

3. The clamping device according to claim 2, wherein a distance between the carrier platform and the tool carrier is adjustable.

4. The clamping device according to claim 1, comprising a lifting device for raising and lowering the movable clamping jaw.

5. The clamping device according to claim 4, wherein the lifting device is mounted on an additional carrier platform arranged above the carrier platform having the opening.

6. The clamping device according to claim 5, wherein the additional carrier platform is mounted so as to be supported against the carrier platform having the opening.

7. The clamping device according to claim 1, further comprising guide means for vertically guiding the movable clamping jaw.

8. The clamping device according to claim 7, wherein the guide means comprise guide rods which project from the carrier platform and are guided in bushings mounted on a plate connected to an upper side of the movable clamping jaw.

9. The clamping device according to claim 1, wherein the bayonet clamping device comprises a bayonet ring mounted on the movable clamping jaw.

10. The clamping device according to claim 9, wherein the bayonet clamping device has a plurality of hooks forming a toothed rim around the bayonet ring and forming the opening in the carrier platform.

11. The clamping device according to claim 8, wherein the plate has openings for application bearings for effecting a clamping rotation of the bayonet ring, wherein the application bearings are connected to the bayonet ring.

12. The clamping device according to claim 2, wherein the carrier platform comprises an annular part provided with the opening and the hooking parts, bushing parts for connecting the platform to the holder columns, and plate braces for connecting the bushing parts to the annular part.

13. The clamping device according to claim 1, wherein the forming tool has a mold cavity, the clamping device further comprising a counter-clamping device for counter-acting deformation of the mold cavity.

14. The clamping device according to claim 13, wherein the counter-clamping device comprises a counter-pressure chamber acted upon by fluid pressure.

15. The clamping device according to claim 14, further comprising a short-stroke cylinder forming the counter-pressure chamber, wherein the short-stroke cylinder acts on the clamping jaw or the tool.

16. The clamping device according to claim 14, wherein the counter-pressure chamber is formed in the movable clamping jaw.

17. The clamping device according to claim 16, wherein the movable clamping jaw comprises a jaw part configured to rest against the forming tool, wherein the jaw part has a portion comprised of a pressure piston acted upon by the fluid pressure of the counter-pressure chamber.

18. The clamping device according to claim 16, wherein the counter-pressure chamber has a sealing lining formed by a plastic membrane.

19. The clamping device according to claim 1, wherein the tool carrier has undercut grooves for effecting a clamping fastening of the tool parts.

20. The clamping device according to claim 2, wherein the tool carrier is plate-shaped.

* * * * *